United States Patent [19]

Fisher et al.

[11] 4,238,642

[45] Dec. 9, 1980

[54] ANGLE-MODULATED STEREO SYSTEM

[76] Inventors: Charles B. Fisher, 2850 Hill Park Rd., Montreal, Quebec H3H 1T1, Canada; Sidney T. Fisher, 53 Morrison, Montreal, Quebec H3P 3C6, Canada

[21] Appl. No.: 58,152

[22] Filed: Jul. 17, 1979

[51] Int. Cl.[3] ..... H04H 5/00

[52] U.S. Cl. ..... 179/1 GC; 179/1 GS; 329/50; 329/167; 332/21; 332/40

[58] Field of Search ..... 179/1 GS, 1 GC, 1 GB; 325/36; 329/50, 167; 332/17, 21, 22, 40, 41

[56] References Cited

U.S. PATENT DOCUMENTS

| | | | |
|---|---|---|---|
| 3,069,679 | 12/1962 | Sweeney et al. | 179/1 GS |
| 3,148,342 | 9/1964 | Holt | 179/1 GS |
| 3,218,393 | 11/1965 | Kahn | 325/36 |
| 3,231,672 | 1/1966 | Collins et al. | 179/1 GS |

OTHER PUBLICATIONS

*Radio Engineers Handbook,* by Terman, McGraw-Hill, 1943.

*Transmission Systems for Communications* by Bell Telephone Labs, 1971, pp. 116 to 118 & 125 to 128.

*Reference Data for Radio Engineers,* N.Y. 1970, pp. 21–14.

Black, *Modulation Theory,* New York 1953, pp. 37 to 42.

"AM Stereo: Five Competing Options," *I.E.E.E. Spectrum,* Jun. 1978 pp. 24–31.

R. Weiss "Heart-Sound Discriminator . . ." *Electronics* 34:24 p. 52, 1968.

Prigozy, "Zero Crossing Detector . . ." Electronics, Apr. 19, 1965, p. 91.

Ferrara, "Delayed Output Pulse Generator" *EEE* 13:10 p. 71.

*Primary Examiner*—Douglas W. Olms

[57] ABSTRACT

An angle-modulated transmitter generates a two-channel stereo wave by double-sideband angle modulation of a carrier with a first signal, double-sideband angle modulation of the same carrier, delayed less than 90°, with a second signal, and addition of the two modulated waves linearly, or an equivalent method, to produce a combined wave from which the two signals can be readily separated, which can compatibly be received by an f-m mono receiver, and which occupies the frequency band of a mono channel of the same bandwidth and deviation ratio.

3 Claims, 3 Drawing Figures

ANGLE-MODULATED STEREO SYSTEM

BACKGROUND OF THE INVENTION

Transmitters for producing f-m stereo signals are well known in the prior art. These have the disadvantages of poor signal-to-noise ratio at the receiver output (21 db below mono reception), the stereo channels are separated incompletely by the receiver, and a relatively complicated transmitter and receiver are required. The prior art for stereo f-m transmission is given by L. J. Giacoletto in "The Electronic Designer's Handbook," New York 1977, pages 25–53 to 23–57 inclusive.

BRIEF DESCRIPTION OF THE INVENTION

The invention comprises transmitting apparatus which angle modulates a first carrier with a first signal, and angle modulates with a second signal a second carrier having the same frequency as, approximately the same amplitude as, and a phase difference of more than 20° and less than 90° from, the first carrier, to produce a combined wave. Alternate means of producing an equivalent combined wave is to provide an angle modulator and an amplitude modulator in tandem which modulate a carrier. Such a wave can be received compatibly by a mono f-m receiver with or without limiting. In the receiving apparatus the combined wave is passed through a frequency discriminator which converts the combined wave into an output wave comprising the first carrier amplitude modulated by the first signal and the second carrier amplitude modulated by the second signal. The output wave is sampled at instants of zero crossing of the first amplitude-modulated carrier at a frequency greater than the Nyquist frequency for the second amplitude-modulated carrier, and the samples are integrated in a low-pass filter to produce the second signal substantially free from the first signal. The first signal is produced in a similar manner from samples of the output wave taken at instants of zero crossings of the second signal amplitude-modulated carrier. The receiving apparatus does not include an amplitude limiter ahead of the frequency discriminator but other methods of noise reduction may be used.

LIST OF DRAWINGS

DETAILED DESCRIPTION OF THE INVENTION

Figure 1:
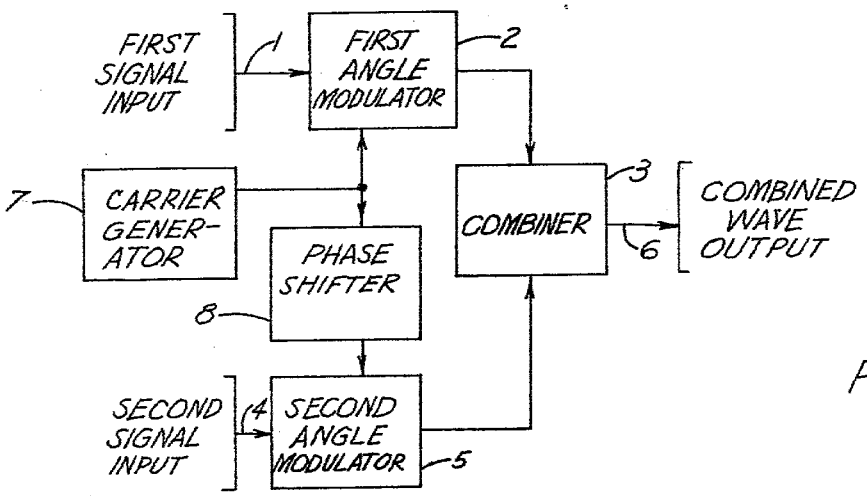
FIG. 1 shows a simplified schematic block diagram of a transmitting apparatus using two angle modulators, according to the invention.

FIG. 1 shows in simplified block schematic form one type of transmitting apparatus according to the invention. A first signal is delivered by lead 1 to first angle modulator 2 and a first angle-modulated wave is delivered to combiner 3. A second signal is delivered by lead 4 to second angle modulator 5 and a second angle-modulated wave is delivered to combiner 3, which delivers the combined angle-modulated output wave over lead 6. Carrier generator 7 delivers a carrier of substantially constant amplitude and frequency to first angle modulator 2 and a carrier shifted in phase by more than 20° but less than 90° through phase shifter 8 to second angle modulator 5. The reason for the limitations or phase shift is that if it is too small the receiving apparatus cannot adequately separate the two signals in the combined wave and if it is too large a mono f-m receiver will show considerable distortion. The preferable range is 30° to 45°.

Figure 2:
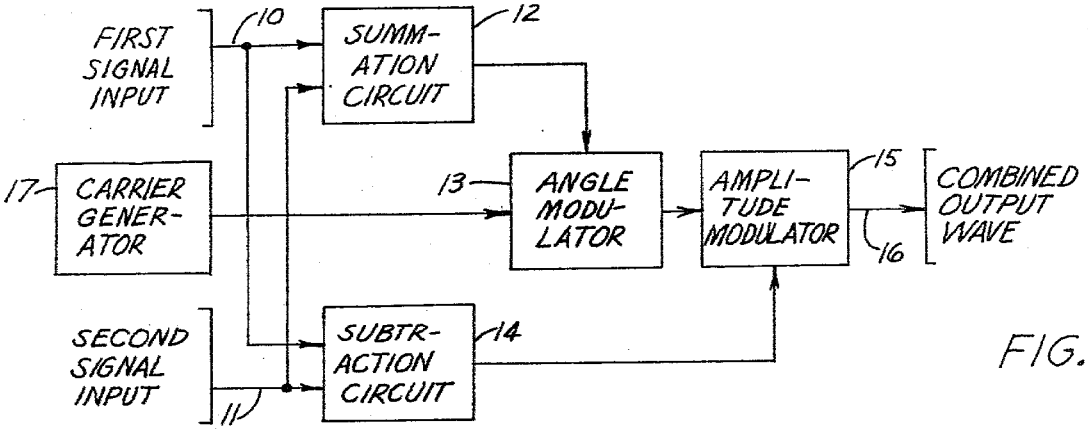
FIG. 2 shows a simplified schematic block diagram of a transmitting apparatus using an angle modulator and an amplitude modulator.

FIG. 2 shows in simplified block-schematic form a second type of suitable transmitting apparatus. A first signal is delivered by lead 10 to signal summation circuit 12 and signal substraction circuit 14. A second signal is delivered by lead 11 also to signal summation circuit 12 and signal subtraction circuit 14. Carrier generator 17 supplies a carrier of substantially constant amplitude and frequency through angle modulator 13 and amplitude modulator 15 to combined output lead 16. Modulators 13 and 15 may be interchanged in order. The output of signal summation circuit 12 supplies modulating power to angle modulator 13, and the output of signal subtraction circuit 14 supplies modulating power to amplitude modulator 15. The depth of modulation of amplitude modulator 15 is adjusted so that the combined output wave on lead 16 is identical to the combined output wave on lead 6 of FIG. 1, when the signals on leads 1 and 10 are identical, the signals on leads 4 and 11 are identical, the outputs of carrier generator 7 and 17 are identical and phase shifter 8 has a phase shift of some value greater than 20° and less than 90°.

Figure 3:
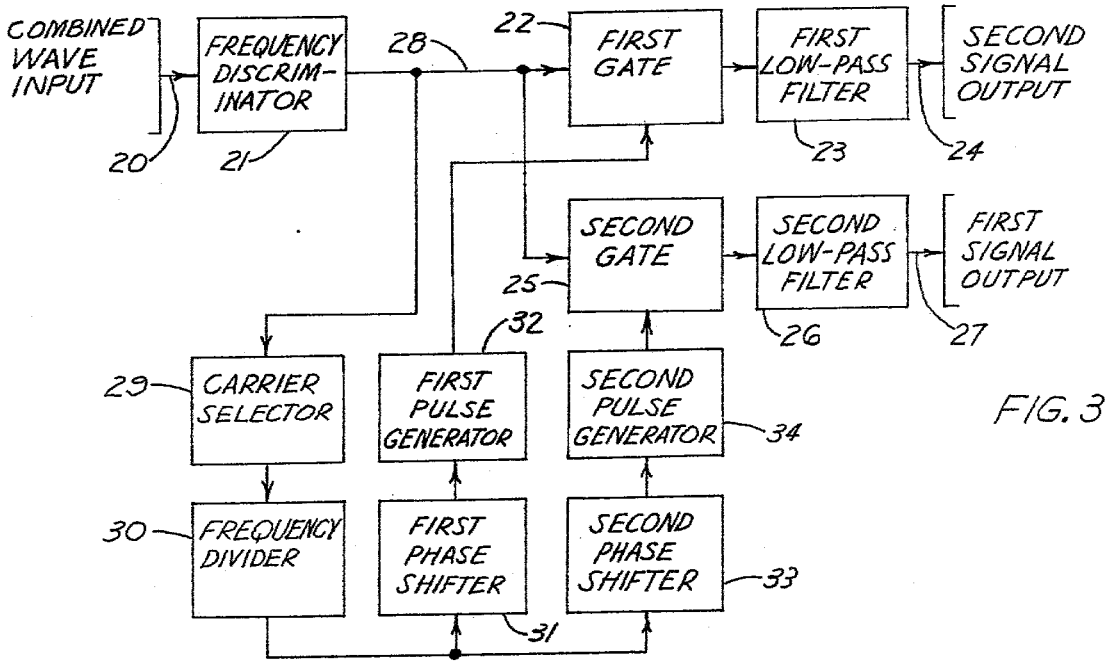
FIG. 3 shows a simplified schematic block diagram of a receiving apparatus according to the invention.

FIG. 3 shows in simplified block schematic form a receiving apparatus which receives and separates the two signals involved in the combined wave output of FIG. 1 or FIG. 2.

The combined wave, preferably from the i-f amplifier of the receiver, but without amplitude limiting, is delivered by input lead 20 to frequency discriminator 21. This is a well known device which converts the combined wave input to a combined wave of a first and second carrier of the same frequency, approximately the same amplitude and spaced in phase by more than 20° and less than 90°, the first carrier double-sideband amplitude modulated by the first signal, and the second carrier double-sideband amplitude modulated by the second signal. The output of frequency discriminator 21 is delivered by means of lead 28 to first gate 22, second gate 25 and carrier selector 29. Carrier selector 29 selects the combined carrier free from noise and sidebands by means including one or more of selectivity, amplitude limiting and oscillator synchronization. The output of carrier selector 29 is divided in frequency by the ratio of two integers in frequency divider 30, which delivers its output to first phase shifter 31 and second phase shifter 33, and through second phase shifter 33 to second pulse generator 34. First phase shifter 31 delivers its output to first pulse generator 32, which delivers a sequence of gating pulses to first gate 22 at instants of zero crossings of the first carrier at this gate, at a frequency greater than the minimum sampling or Nyquist frequency for the second carrier amplitude modulated by the second signal. Thus the output of first gate 22 consists of a sequence of samples of the second carrier amplitude modulated by the second signal, which fully define the second signal and are integrated in first low-pass filter 23 with a cut-off at the highest frequency of the second signal, to deliver the second signal substantially free from the first signal to output lead 24.

Second pulse generator 34 delivers a sequence of gating pulses to second gate 25 at instants of zero crossings of the second carrier at this gate, at a frequency greater than the minimum sampling or Nyquist frequency for the first carrier amplitude modulated by the first signal. Thus the output of second gate 25 consists of a sequence of samples of the first carrier amplitude modulated by the first signal, which fully define the first signal and are integrated in second low-pass filter 26 with a cut-off at the highest frequency of the first signal, to deliver the first signal substantially free from the second signal to output lead 27.

We claim:

1. A system for transmission of a first and a second signal simultaneously over a channel, without mutual interference between said signals, which comprises:

transmitting apparatus which has substantially linear amplitude response and flat frequency response over the range of amplitude and frequency of the transmitted wave, and generates and transmits a combined carrier angle modulated by said first signal, and amplitude modulated by said second signal, and receiving apparatus, which receives said combined carrier and has substantially linear amplitude response and flat frequency response over the range of amplitude and frequency of said combined carrier, up to and including a discriminator means, the discriminator means being connected to receive said combined carrier, and also comprises pulse generating, sampling and reconstruction filter means for producing said first and second signals separately, without substantial mutual interference between said signals.

2. Transmitting apparatus for transmission of a first and a second signal simultaneously over a channel, without mutual interference between said signals, which comprises:

a source of a first signal, which may be a first program, a first stereo channel of said first program, or the sum of two stereo channels of said first program, and a source of a second signal, which may be said first program, a second program unrelated to said first program, a second stereo channel of said first program when said first signal is said first stereo channel of said first program, or the difference of the two stereo channels of said first program when said first signal is said sum of stereo channels of said first program, and a source of a carrier of substantially constant frequency and amplitude which provides a first and second carrier the same in frequency and substantially equal in amplitude, but differing in phase by an angle between 20° and 90°, and a first angle modulator which receives said first signal and said first carrier and angle modulates said first carrier with said first signal, and a second angle modulator which receives said second signal and said second carrier, and angle modulates said second carrier by said second signal, and combiner, amplifying and transmission means, which receive the outputs of said first and second angle modulators and combine said outputs to produce a combined wave, amplify said combined wave, and transmit said combined wave over transmission means, each of said combiner, amplifying and transmission means having a substantially linear amplitude response and a flat frequency response over the ranges of amplitude and frequency of said combined wave.

3. Receiving apparatus which receives a combined wave made up of or equivalent to a first carrier angle modulated by a first signal and a second carrier of the same frequency and substantially the same amplitude as, but differing in phase from said first carrier by more than 20° and less than 90° relative to said first carrier, angle modulated by said second signal, and which delivers said first and said second signals without substantial mutual interference, which comprises:

amplifying and selective means which have substantially linear amplitude response and flat frequency response over the amplitude and frequency range of said combined wave, and discriminator means comprising one or more tuned circuits which receives the output of said amplifying and selective means, and which has an output amplitude which varies linearly with input amplitude and with input frequency, which converts said first carrier angle modulated by said first signal to said first carrier amplitude modulated by said first signal, and converts said second carrier angle modulated by said second signal to said second carrier amplitude modulated by said second signal, and first gating means, which receives as input the output of said discriminator means, and receives as gating pulses a sequence of regularly-occurring short pulses substantially centered on instants of some or all of the zero crossings of said first carrier amplitude modulated by said first signal, with a repetition frequency greater than the minimum sampling or Nyquist frequency of said second carrier amplitude modulated by said second signal, and delivers a sequence of samples of the output of said discriminator means, consisting of samples of said second carrier amplitude modulated by said second signal and substantially free from said first carrier amplitude modulated by said first signal, and second gating means, which receives as input the output of said discriminator means, and receives as gating pulses a sequence of regularly-occurring short pulses substantially centered on instants of some or all of the zero crossings of said second carrier amplitude modulated by said second signal, with a repetition frequency greater than the minimum sampling or Nyquist frequency of said first carrier amplitude modulated by said first signal, and delivers a sequence of samples of the output of said discriminator means, consisting of samples of said first carrier amplitude modulated by said first signal and substantially free from said second carrier amplitude modulated by said second signal, and first low-pass filter means with a cut-off frequency equal to or higher than the highest frequency of said second signal and lower than the pulse repetition frequency of said first sampling gate less the highest frequency of said second signal, which reconstructs in analog form the sequence of samples from said first sampling means and delivers said second signal, substantially free from said first signal, to a first external circuit, and second low-pass filter means with a cut-off frequency equal to or higher than the highest frequency of said first signal and lower than the pulse repetition frequency of said second sampling gate less the highest frequency of said first signal, which reconstructs in analog form the sequence of samples from said second sampling means and delivers said first signal, substantially free from said second signal, to a second external circuit, and carrier selector means which receives the output of said frequency discriminator means and utilizes one or more of selectivity, amplitude limiting and oscillator synchronization to deliver the sum of said first carrier and said second carrier, which is a combined carrier with the same frequency as said first and second carriers, substantially free from sidebands and noise, and frequency divider means which receives said combined carrier from said carrier selector means and divides the frequency of said combined carrier means by the ratio of two positive integers, and first pulse timing and pulse generating means which receives the output of said frequency divider means and from said output produces and delivers as gating pulses to said first gate a first sequence of short pulses, centered in time on instants of zero crossings of said first carrier at the input to said first gate, with a repetition frequency greater than the minimum sampling or Nyquist frequency of said second carrier amplitude modulated by said second signal, and second pulse timing and pulse generating means which receives the output of said frequency divider and from said output produces and delivers as gating pulses to said second gate a second sequence of short pulses, centered in time on instants of zero crossing of said second carrier at the input to said second gate, with a repetition frequency greater than the minimum sampling or Nyquist frequency of said second carrier amplitude modulated by said second signal.

* * * * *